United States Patent [19]

Smith

[11] Patent Number: 4,525,653

[45] Date of Patent: Jun. 25, 1985

[54] MODULAR DISPLAY APPARATUS WITH MEANS FOR PREVENTING BRIGHTNESS VARIATIONS

[75] Inventor: James Smith, Reigate, England

[73] Assignee: U.S. Philips Corporation, New York, N.Y.

[21] Appl. No.: 529,259

[22] Filed: Sep. 6, 1983

[30] Foreign Application Priority Data

Sep. 17, 1982 [GB] United Kingdom ..... 8226501

[51] Int. Cl.[3] ..... H01J 29/70; H01J 29/72

[52] U.S. Cl. ..... 315/366; 315/383; 313/422

[58] Field of Search ..... 315/366, 383, 30; 313/422, 103 CM, 105 CM

[56] References Cited

U.S. PATENT DOCUMENTS 3,935,500 1/1976 Oess et al. ..... 313/422
4,024,391 5/1977 Bosserman et al. ..... 313/105 CM
4,121,137 10/1978 Credelle ..... 315/366
4,344,021 8/1982 Johnston ..... 315/366
4,417,184 11/1983 Takesako et al. ..... 313/422

*Primary Examiner*—Theodore M. Blum
*Attorney, Agent, or Firm*—Robert J. Kraus

[57] ABSTRACT

A display apparatus including a modular type display tube having a cathodoluminescent screen, elongate thermionic or P-N electron emitters, a channel plate electron multiplier and an apertured control plate between the emitters and the multiplier. The control plate has a plurality of switching electrodes on the side facing the emitter and a set of brightness electrodes on the opposite side and extending transversely to the switching electrodes. In order to compensate for variations in emission from the emitters, the brightness voltage to the brightness electrodes is turned-off and emission variations are measured by scanning using the switching electrodes. Correction voltages are computed and applied together with the modulation signal in synchronism with the scanning of the switching electrodes. An apertured shielding plate is provided to prevent the switching voltages at the switching electrodes from affecting the emissions from the emitters.

14 Claims, 7 Drawing Figures

MODULAR DISPLAY APPARATUS WITH MEANS FOR PREVENTING BRIGHTNESS VARIATIONS

BACKGROUND OF THE INVENTION

1. Field of the Invention

The present invention relates to a display apparatus including a cathode ray display tube, more particularly a flat display tube comprising an envelope in which there is provided a source of electrons and a screen.

2. Description of the Prior Art

There have been many proposals for flat display tubes. Amongst these proposals is that disclosed by Texas Instruments at the Society of Information Display Seminar in 1978 and published in SID 78 Digest pages 88 and 89. The tube disclosed comprises a metal shell envelope having an optically transparent faceplate on which a cathodoluminescent screen is provided, an area cathode is provided opposite the screen and between the cathode and the screen is an apertured switching stack which in response to addressing forms and controls multiple electron beams. The area cathode comprises a plurality of stretched wire oxide coated tungsten filaments spaced approximately 3 mm apart. Field shaping electrodes are provided to obtain a uniform electron emission over the whole area of the cathode. The switching stack is operated according to an X-Y addressing system so that electrons can only pass through a selected aperture or selected apertures at any one time. Whilst this proposed tube did produce an image on the screen it is acknowledged by the engineers involved to be inferior compared to a conventional cathode ray tube due to having fewer pixels. However this proposed tube also suffered from other disadvantages, one of which is its high power consumption due to having the area cathode continuously on and only using a minute fraction of the electrons produced at any one time. Another disadvantage is that oxide coated filaments do not emit electrons homogeneously and in consequence in spite of having field shaping electrodes to equalise the distribution of electrons which are produced, it is not possible to ensure that there is an even emission of electrons across the entire area of the cathode because of the differences in emission from each of the filaments. In consequence a non-uniform image will be displayed.

It is an object of the present invention to overcome these disadvantages and to provide a display apparatus having a lower power consumption and a uniform image.

SUMMARY OF THE INVENTION

According to the present invention there is provided a display apparatus comprising a flat display tube having a cathodoluminescent screen, electron producing means, and an apertured control plate having a plurality of switching electrodes on a side facing the electron producing means. The switching electrodes respond to addressing signals controlling the passage of electrons through at least one predetermined aperture in the control plate. One or more brightness control electrodes on the other side of the control plate receive a modulating signal and a voltage for correcting variations in emission of the electron producing means. Correction voltage determining means is provided for measuring the emission incident on the control plate and for determining the correction voltage to be applied to each brightness electrode in synchronism with the addressing of the switching electrodes.

By correcting the variations in brightness due to variations in the emission from the electron producing means, the apparent periodic variation in brightness of an image as viewed is significantly reduced or eliminated. The electron producing means may comprise linear emitters in the form of stretched wire thermionic emitters, indirectly heated emitters or P-N emitters.

In order to reduce the power consumption of the flat display tube, the electron producing means may produce low current, low voltage electrons which after being switched by the switching electrodes of the control plate undergo current multiplication in a channel plate electron multiplier. By arranging the electron multiplier after the control plate only the electrons which are passed by the control plate and form a brightness modulated and corrected beam are current multiplied.

In order to prevent the addressing of the switching electrodes from affecting the distribution of the electrons produced by the electron producing means, an apertured shielding plate may be disposed in front of the switching electrodes.

If the shielding plate is divided into individually addressable segments which extend parallel to the switching electrodes then it is possible to arrange the switching electrodes into sections and interconnect corresponding electrodes in these sections. Thus not only is it possible to reduce the number of external connections but also to enable line-by-line addressing to be carried out.

Alternatively if the brightness control electrodes are transverse to the switching electrodes and the shileding plate is segmented with the segments extending parallel to the brightness electrodes and being individually addressable, then matrix addressing is possible whilst at the same time the brightness of the addressed electron beam is modulated and corrected.

The interior of the display tube may be divided into modules with each module having its own electron emitter. In one embodiment the control plate and the electron multiplier each have a single column of apertures per module and, in order to obtain scanning transverse to the column of apertures, beam deflector electrodes are provided on partitions extending between the electron multiplier and the screen.

The present invention also provides a flat display tube comprising an envelope having a faceplate on which a cathodoluminescent screen is provided, a channel plate electron multiplier arranged parallel to the screen and having an input face and an output face, and electron producing means for supplying electrons over an area corresponding to substantially the whole of the input face of the electron multiplier.

BRIEF DESCRIPTION OF THE DRAWINGS

The present invention will now be described, by way of example, with reference to the accompanying drawings, wherein.

DESCRIPTION OF THE PREFERRED EMBODIMENTS

Figure 1:
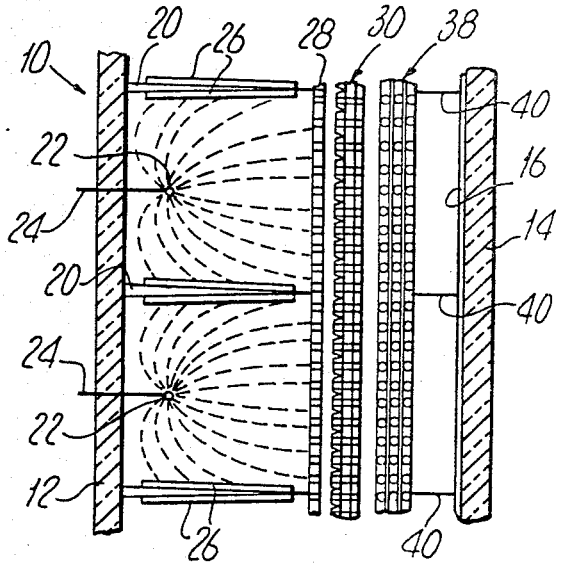
FIG. 1 is a diagrammatic cross-sectional view of a portion of a display tube including a shielding plate, a control plate and a laminated channel plate multiplier.

In the drawing figures, corresponding reference numerals will be used to illustrate the same parts. Furthermore it is pointed out that for the sake of clarity the drawings are not to scale.

The display tube 10 comprises an envelope formed by a glass or metal dished member 12 having a rectangular opening which is closed by a substantially flat, optically transparent faceplate 14. A suitable hermetic seal, e.g. a frit seal, is provided between the faceplate 14 and the adjoining portions of the member 12. In the case of a large area display the faceplate 14 may have an area on the order of 1 square meter, for example 1.3 m×0.77 m. A cathodoluminescent screen 16 is provided on the faceplate 14.

The interior of the envelope may be considered as comprising a plurality of horizontally extending modules 18A to 18E (FIG. 5), each module having a height of say 32 mm. Each module 18A to 18E is separated from an adjacent module by means of a horizontally extending wall 20.

An elongate source of electrons is provided in each module 18A to 18E. The sources may be of any suitable continuously emitting linear type, for example stretched wire thermionic sources 22, as illustrated, tubular, indirectly heated cathodes or cold emitters such as linear arrays of P-N emitters of the type disclosed in British Patent Specification No. 2,013,398A details of which are incorporated by way of reference. In the case of using stretched wire sources 22 they are supported along their lengths at say 20 mm intervals by means of electrically conductive supports 24 which pass through the wall of the member 12. Alternate supports 24 of each stretched wire source 22 are interconnected electrically. By connecting the supports 24 in this way the voltage drop per unit length of the stretched wire source can be maintained substantially constant whereas this may not be the case if a potential difference is applied between the ends of the stretched wire. The broken lines in FIG. 1 illustrate the electrons emitted by each source 22. Field shaping electrodes 26 are provided on the walls 20 of each module in order to obtain a more homogeneous distribution of electrons over the area of the module. In the case of the dished member 12 being made of a non-electrically conductive material then the wall of the envelope behind the sources 22 is metallised to prevent charges accumulating thereon.

An apertured, electrically conductive, shielding plate 28 is provided across the ends of the walls 20. The size, pitch and distribution of the apertures in the plate 28 are determined by the desired resolution of the image to be displayed on the screen 16. In the case of a television tube the apertures may be considered as being arranged in rows with N rows per module. The purpose of the shielding plate 28 is to isolate the field produced by the electrodes 26 from the effects of the switching operation to be carried out by a control plate 30.

Figure 2:
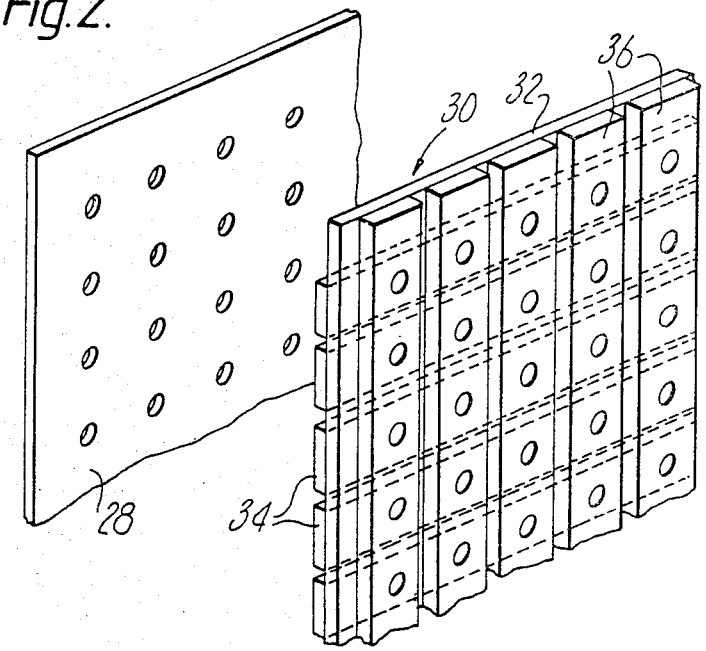
FIG. 2 is a diagrammatic perspective vie of a portion of a shielding plate and a control plate.

The control plate 30 comprises an apertured carrier sheet 32 (FIG. 2) having a substantially identical arrangement of apertures as in the shielding plate 28. On one side of the sheet 32 are provided a plurality of horizontally elongate switching electrodes 34 (FIG. 2), one electrode for each row of apertures. The electrodes 34 have apertures to permit electrons to pass through associated apertures in the sheet 32. The height of each electrode 34 is such that it is able to surround the apertures in the sheet. By suitably addressing the switching electrodes 34, electrons can be allowed to pass through, or prevented from passing through, the apertures in the sheet 32. Because the electrodes 34 extend horizontally, a row of apertures can be addressed at a time.

On the reverse side of the sheet 32 a plurality of vertically extending brightness control electrodes 36 are provided. Like the electrodes 34, the electrodes 36 have apertures at locations corresponding to the apertures in the sheet 32 and are of such a width as to surround the apertures in the sheet 32. By suitably modulating the voltage applied to each electrode 36 the intensity of the electron beam(s) passing therethrough can be varied. At least the surface of the sheet 32 has a high electrical resistance to prevent the electrodes 34 and 36 shorting-out.

Between the control plate 30 and the screen 16, a laminated channel plate electron multiplier 38 is provided. The purpose of the electron multiplier 38 is to current multiply the electron beam(s) from the control plate 30, which are low current, low voltage beams used to minimise the power consumption by the display tube. The details of the fabrication of the electron multiplier 38 will not be given here because they are disclosed in detail elsewhere such as in published British Patent Specification Nos. 1,401,969, 1,434,053 and 2,023,332A. However, for those not familiar with this type of electron multiplier, it comprises a stack of spaced-apart, barrel-shape apertured, mild steel sheets held at progressively higher voltages. The pitch of the apertures corresponds to that in the sheet 32. The apertures in the plates are aligned to form channels and contain a secondary emitting material. An electron striking the wall of an aperture in a first dynode produces a number of secondary electrons, each of which on impacting with the wall of an aperture in a second dynode produces more secondary electrons, and so on. The stream of electrons leaving the final dynode is accelerated towards the screen by an accelerating field established between the output of the electron multiplier 38 and an optically transparent, post deflection acceleration (PDA) electrode (not shown) on the screen 16. The number of dynodes depends upon the intended application but in the case of the illustrated display tube 10 the number will typically be four.

In order to enable the faceplate 14 to withstand the atmospheric pressure without having to be unduly thick, supports 40 are provided between the output dynode of the channel plate multiplier 38 and the faceplate 14. The supports 40 must be of small cross-section in order not to be obtrusive to a user of the display tube 10. Accordingly the supports 40 may be columnar or thin strips of material. Further, the surfaces of the supports 40 should be very slightly electrically conductive to avoid the build-up of charges.

The operation of the display tube 10 will now be described in general terms. In the case of the tube including the current multiplier 38, low current, low voltage electrons are produced continuously by the stretched wire sources 22 and are directed towards an input side of the shielding plate 28. Those electrons which pass through the apertures in the plate 28 comprise a plurality of low current, low voltage electron beams which are incident on the control plate 30. Depending on the addressing applied to the switching electrodes 34, all the electron beams can pass through their associated apertures in the sheet 32 or a single row or a plurality of rows of electron beams can pass through their associated apertures in the sheet 32. Those beams which pass through the apertures in the sheet 32 are subjected to brightness modulation and brightness correction before entering an associated aperture in the current multiplier 38. Each current multiplied electron beam leaving the current multiplier 38 undergoes post deflection acceleration before impinging on the screen 16.

It should be mentioned that if the electrons emitted by the sources 24 are at a high energy then it may not be necessary to amplify them using the current multiplier 38. Thus in its simplest form the display tube need only comprise the sources 22, the control plate 30 and the screen 16. The shielding plate 28 although optional ensures that the switching voltages on the electrodes 34 of the control plate 30 do not affect the electron distribution in each of the modules 18A to 18E. Additionally it serves as a collector for the surplus electrons which do not pass through the apertures therein.

The power saving achieved by using relatively widely spaced (every 32 mm), low current, low voltage electron sources 22 and only amplifying that (or those) electron beam(s) which is (or are) passed by the control plate 30 is significant. An estimated power consumption figure is 100 W for the illustrated display tube 10 having a faceplate area of 1 $m^2$ in comparison with an estimated 2 kW for a prior art tube of similar faceplate area and having electron sources every 3 mm.

Figure 3:
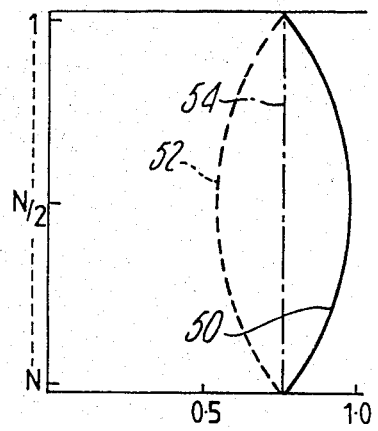
FIG. 3 is a graph illustrating the variation of the relative electron current density across a module of the display tube having N lines.
Figure 4:
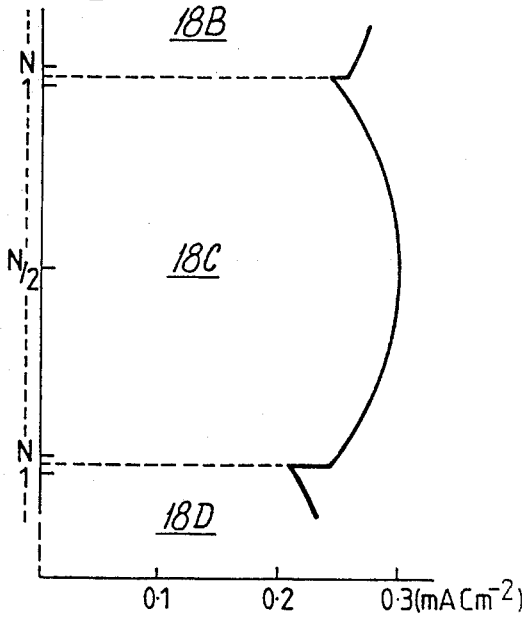
FIG. 4 is a graph illustrating the variation of the actual electron current density between three adjacent modules.

In order to overcome the brightness variations due to (a) variation in the emission from each source 22, principally from differences in emission along the length of each source, (b) relative differences in the emission between one source and the next, and (c) unequal field distribution within equal module, correction voltages are applied to the electrodes 36 in addition to the modulating signals. FIG. 3 illustrates by a continuous line 50 the typical variation of the relative electron current density across a module 18A to 18E having N-lines where N is say 32. In FIG. 3 the ordinate is the line number and the abscissa the relative current density. The relative current density is generally at a maximum in the middle of each module and a minima at the top and bottom of each module. The minima is due in part to the effect of the wall electrodes 26 in modifying the field distribution in each module. Because of the variations in the emissions from the sources 22, it frequently occurs that there are different minima and maxima between the modules with the result that there are jumps in the actual current density when passing from one module to the next, for example as illustrated in FIG. 4. Accordingly in overcoming these variations in brightness it is necessary to consider not only what is happening within each module but also what is happening between adjacent modules.

Figure 5:
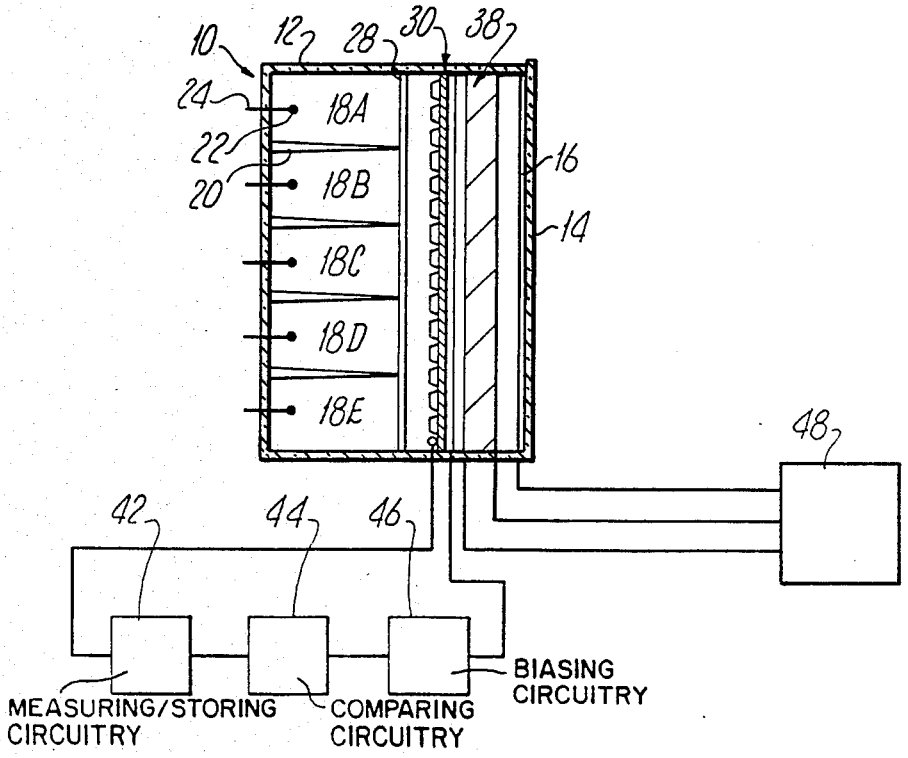
FIG. 5 is a schematic diagram of a display apparatus made in accordance with the present invention.

In the case of the display system illustrated in FIG. 5 it is proposed to apply a modulating voltage and a brightness correction voltage to the electrodes 36 in synchronism with the addressing of the switching electrodes 34. In order to determine the brightness correction voltage to be applied, the switching electrodes 34 are used as measuring probes. More specifically, during the fly-back period between successive frames, the voltages applied to the brightness control electrodes 36 are switched-off. The electron beams formed by the electrons passing through the apertures in the shielding plate 28 impinge on the electrodes 34 which are scanned in turn in the vertical direction and the current in each one is measured and stored in memory indicated schematically by the block 42. The current stored varies due to the electron density varying somewhat as shown in FIG. 4. During the line-by-line scanning of the next following frame, the current values stored are read-out in synchronism with the addressing of the electrodes 34 and these values are compared with a reference value in a comparator 44. The result of the comparison is used to adjust the output of a biasing circuit 46 connected to the electrodes 36. The biasing voltage, which is additional to the modulating signal, varies in an opposite manner to the variation in the relative current density, see the broken line 52 in FIG. 3, so that the result of the correction is a linearising of the quiescent current density at the output of the control plate 30, as is illustrated by the chain-dot line 54 in FIG. 3.

For the sake of completeness the box 48 indicates schematically the power supply for the current multiplier 38 and the PDA electrode.

In fabricating the display tube 10, the orthogonal pitch of the apertures in the screening plate 28, control plate 30 and the current multiplier 38 is typically 1 mm for a screen measuring 1.3 m×0.77 m. Although the plates 28 and 30 and the current multiplier 38 have been shown separate it is desirable that the plates 28 and 30 be mounted on the current multiplier 38 so as to make a more compact assembly. In order to reduce the thermal stresses in such an assembly it is advantageous if the material of the shielding plate 28 and the sheet 32 is the same as that of the dynodes, in the present example this is mild steel. However, as it is not possible to make satisfactory glass-to-metal seals using mild steel, any lead-outs will have to be of a suitable material, for example gold or silver. If it is desired to produce a coloured picture then a colour selector can be mounted on the output of the channel plate current multiplier 38 and the screen can comprise triplets of vertical stripes of green, red and blue emitting phosphors. A suitable colour selector is disclosed for example in British Patent Application No. 8217410 (corresponding to U.S. patent application Ser. No. 502,889 filed June 9, 1983) details of which are incorporated by way of reference.

In order to reduce the number of external connections and still achieve line-by-line addressing, the shielding plate 28 may itself be divided into horizontal segments, one for each module, and corresponding switching electrodes 34 of the modules 18A to 18E may be interconnected. In operation each segment is switched from an "off" to an "on" state as required whilst simultaneous scanning of the switching electrodes 34 take place. Thus instead of say 770 horizontal line connections connected respectively to the switching electrodes 34 plus one connection to the screening electrode, one has 32 line connections (assuming N (FIGS. 3 and 4) equals 32) plus 24 shielding electrodes (assuming the tube 10 comprises 24 modules).

Alternatively by dividing the shielding plate vertically into 26 sections, instead of horizontally as before, a reduction in the number of connections to the brightness electrodes 36 can be achieved by forming the 1300 electrodes 36 into 26 sections each covering 50 cells and interconnecting every 50th brightness electrode. In so doing the number of brightness electrode connections is reduced from 1301 to 76, however the reduced duty factor would mean increased screen current to achieve the same brightness.

Figure 6:
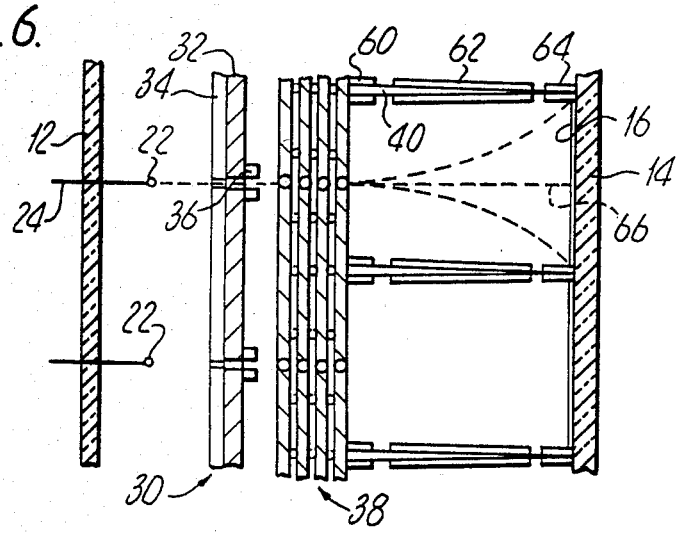
FIG. 6 is a diagrammatic, horizontal cross-sectional view through a portion of another display tube having a control plate and current multiplier.
Figure 7:
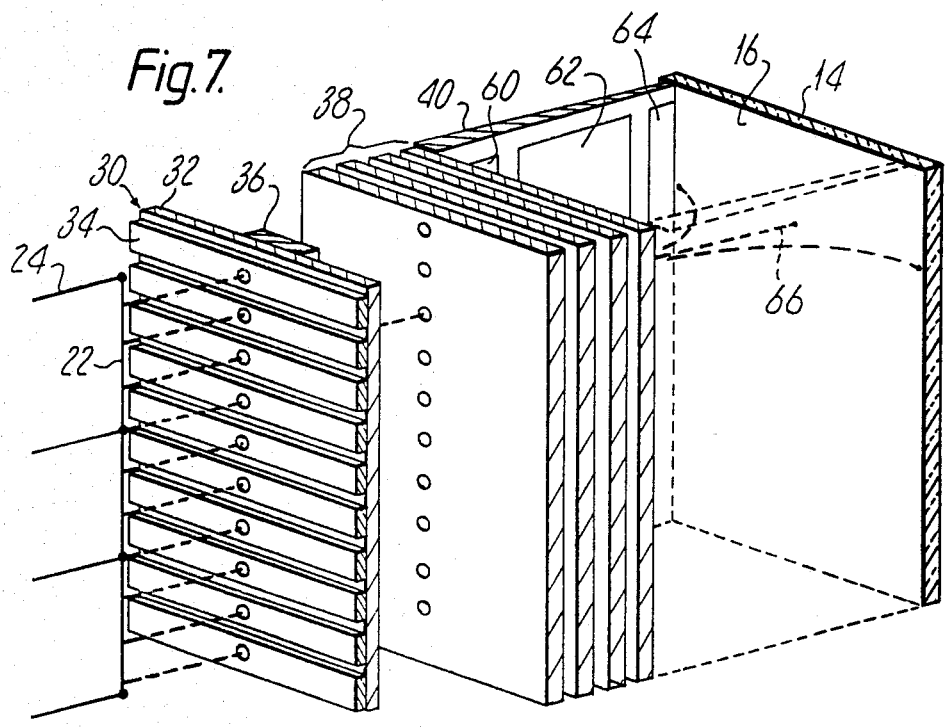
FIG. 7 is a diagrammatic perspective view of a portion of the display tube shown in FIG. 6.

FIGS. 6 and 7 of the accompanying drawings illustrate another embodiment of a display tube which can be used in the display apparatus made in accordance with the present invention.

In the illustrated display tube the modules extend vertically rather than horizontally. Associated with each module is an elongate source of electrons which may be a stretched wire thermionic source 22, as shown, a tubular, indirectly heated cathode or a cold emitter such as a linear array of P-N emitters. The electrons from the source 22 impinge on the input side of a control plate 30 which has a single column of apertures per module and in consequence has a single brightness control electrode 36. The number of apertures in the sheet 32 and their size and pitch correspond to the number of lines in the picture to be displayed. Each of the apertures has its associated switching electrode 34. The operation of the control plate 30 and the correction of any variations in brightness due to the variations in emission from the source 22 is different from that described with reference to FIGS. 1 to 5. In order to measure the current being emitted during the frame fly-back intervals, the electron multiplier 38 is turned-off and the current from the emitter 22 is measured by the brightness electrode 36 as the switching electrodes 34 are energised in sequence. During frame scanning the correction voltages are applied to the brightness electrodes 36.

The output from the addressed aperture in the control plate 30 is incident in an associated channel of the laminated plate electron multiplier 38 which also has a single column of channels per module. The current multiplied beam leaving the multiplier undergoes scanning in the line direction.

In order to scan the beam, opposing sets of electrodes 60, 62 and 64 are provided on the facing surfaces of the tapering support walls 40 which contact the faceplate 14. Between the electrodes 60 and 62 and the electrodes 62 and 64 there may be resistive stripes across each of which there is a progressive potential change so that an electron lens is formed with its opposite stripe. The electrodes 60 are held at the output voltage of the electron multiplier 38 which for ease of reference will be taken as being OV. The electrodes 64 which contact the PDA electrode (not shown) are at say 8 kV relative to the electrodes 60, thus providing an accelerating field. The electrodes 62 are used for line scanning and accordingly the voltage applied to each is varied as required about a mean voltage of 4 kV. If the electrodes 62 are at the same potential then the electron beam will follow a straight trajectory 66 to the screen. However in order that the electron beam can be deflected into the corners formed by the faceplate 14 and the support walls 40 then a deflection voltage swing of the order of 1.6 kV is necessary so that one of the electrodes 62 is at say 3.2 kV and the other is at say 4.8 kV. Although the control plate 30 and the current multiplier 38 can be discrete entities for each module it is more convenient for each to extend the full width of the display tube.

I claim:

1. A display apparatus for successively producing a series of image frames, said apparatus comprising a flat panel cathode-ray display tube including a luminescent screen, a plurality of electron-emitting means and an apertured control plate disposed between the electron emitting means and the screen, said display tube comprising a plurality of modules, each including at least one of the electron-emitting means and a portion of the control plate associated with a respective area of the screen, for producing from distributions of emitted electrons respective areas of the image frames, the improvement comprising:

(a) a plurality of parallel switching electrodes in each module associated with respective rows of apertures in the control plate for controlling the passage of current through said apertures, said switching electrodes being disposed on a side of the control plate facing the electron-emitting means;

(b) at least one brightness control electrode in each module associated with a respective column of apertures in the control plate for controlling the magnitudes of any currents passing through said apertures, said at least one brightness control electrode being disposed on a side of the control plate facing the screen and being oriented transversely to the switching electrodes in the respective module;

(c) means for sequentially measuring the magnitudes of the currents passing through selected apertures in said rows as the switching electrodes are sequentially activated, between successive image frames;

(d) comparing means for determining the differences between the magnitudes of the measured currents and a reference magnitude; and (e) biasing means for applying bias voltages representing the differences to the respective brightness control electrodes associated with the apertures for which the differences were determined, in synchronism with sequential activation of the switching electrodes associated with said apertures, during production of each image frame, to prevent variations in image brightness corresponding to non-uniform electron distributions in the modules.

2. A display apparatus as in claim 1 where the electron emitting means comprise a plurality of linear emitters.

3. A display apparatus as in claim 2 where each linear emitter comprises a stretched wire thermionic emitter.

4. A display apparatus as in claim 3 including means for supporting the stretched wire at intervals along its length.

5. A display apparatus as in claim 2 where each linear emitter comprises an array of P-N semiconductor emitters.

6. A display apparatus as in claim 2 where each module includes a single linear emitter.

7. A display apparatus as in claim 1 where the electron emitting means are of a type which produce low current, low voltage electrons, and where the display tube includes a channel plate electron multiplier disposed between the control plate and the screen.

8. A display apparatus as in claim 1 where the means for measuring the magnitudes of the currents passing through the apertures in the control plate is electrically connected to the switching electrodes.

9. A display apparatus as in claim 1 where the means for measuring the magnitudes of the currents passing through the apertures in the control plate is electrically connected to the brightness control electrodes.

10. A display apparatus as in claim 1, 8 or 9 including an electron shielding plate disposed between the electron emitting means and the control plate, said electron shielding plate including apertures for enabling emitted electrons to pass to the apertures in the control plate.

11. A display apparatus as in claim 10 where the apertures in the shielding plate and the control plate are distributed over substantially the entire surfaces thereof.

12. A display apparatus as in claim 10 where the shielding plate comprises a plurality of segments disposed in respective modules of the display tube, said segments being electrically insulated from each other, and where the switching electrodes in each module are electrically insulated from each other but are each electrically connected to correspondingly located switching electrodes in the other modules in the display tube.

13. A display apparatus as in claim 10 where the shielding plate comprises a plurality of segments, electrically insulated from each other, extending parallel to the brightness control electrodes.

14. A display apparatus as in claim 7 where the control plate and the electron multiplier each have a single column of apertures in each module, and where each module includes a pair of electron beam deflector electrodes extending between the electron multiplier and the screen, the deflector electrodes in each pair being disposed on opposite sides of the respective column of apertures in the electron multiplier.

* * * * *